United States Patent [19]

Thimon

[11] 4,396,122

[45] Aug. 2, 1983

[54] PACKAGE FOR A PALLET-LESS, MULTI-LAYER LOAD COMPRISING A LAYER OF REDUCED WIDTH DEFINING LATERAL SPACES FOR GRIPPING PURPOSES

[75] Inventor: Jacques Thimon, Tresserve, France

[73] Assignee: S.A. Thimon, Aix-les-Bains, France

[21] Appl. No.: 260,702

[22] Filed: May 5, 1981

[30] Foreign Application Priority Data

May 6, 1980 [FR] France ..... 80 10067

[51] Int. Cl.[3] ..... B65D 19/00

[52] U.S. Cl. ..... 206/597; 206/497; 229/55

[58] Field of Search ..... 206/386, 597, 497; 229/DIG. 12, 55

[56] References Cited

U.S. PATENT DOCUMENTS 2,489,054 11/1949 Sprolle ..... 206/386
3,788,462 1/1974 Meincer ..... 206/597
3,853,218 12/1974 Grasvoll ..... 229/DIG. 12
3,884,935 5/1975 Burns ..... 206/597
3,903,673 9/1975 Grasvoll ..... 206/497

*Primary Examiner*—Stephen P. Garbe
*Attorney, Agent, or Firm*—McAulay, Fields, Fisher, Goldstein & Nissen

[57] ABSTRACT

A packing for a pallet-less multi-layer load with a layer of reduced width defining lateral spaces for gripping purposes, each of these spaces, which are parallel to each other, having the form of a right-angled dihedron, comprises a plastic film element for protection and reinforcement applied on the reduced layer and the spaces for gripping. The protecting and reinforcing element is provided, in its parts adapted to be applied respectively on the faces of the dihedrons forming the spaces for gripping, with at least one additional band or strip folded inwardly and forming an extra thickness on the two faces of each of these dihedrons. The protecting and reinforcing element of plastics film is advantageously constituted by a section of sheath with gussets, the gussets being disposed either perpendicularly or parallel to the spaces for gripping.

20 Claims, 11 Drawing Figures

3
9
8c
8
2
8c
10
4
a
b
5
6
7
1

8c
7
8
10
8c

9
L
8
8c
10
8a
8a
8b
8c
8b 11
11a
11b 11a
11
11b
11c
11d 11a
11b
11c
11e
11f
11d

PACKAGE FOR A PALLET-LESS, MULTI-LAYER LOAD COMPRISING A LAYER OF REDUCED WIDTH DEFINING LATERAL SPACES FOR GRIPPING PURPOSES

BACKGROUND OF THE INVENTION

The present invention relates to a package for a pallet-less, multi-layer load comprising a layer of reduced width defining lateral spaces for gripping purposes.

It is presently known to form pallet-less multi-layer loads from a plurality of articles stacked one on the other so as to form a substantially parallelepipedic assembly. These articles, which are, in particular, bags containing products (for example bags of cement), are grouped in superposed layers, each layer having a square or rectangular horizontal form. For forming a load without a pallet, a layer of reduced width is provided at the upper or lower part of the load, during stacking, said "reduced layer" being constituted by fewer articles and defined by a smaller square or rectangular geometrical surface than the preripheral surface of the normal layers. Consequently, the reduced layer defines, with the normal layer on or under which it is formed, two lateral empty spaces parallel to each other and in the form of right-angled dihedrons. The vertical side of each of these dihedrons is constituted by a lateral face of the reduced layer, whilst the horizontal side of this dihedron is formed by the portion of horizontal surface of the adjacent normal layer which remains exposed.

The lateral spaces thus defined by the reduced layer are used to enable the load to be gripped by a fork lift truck or by slings.

Once the load is thus formed with its layer of reduced width, it is packed beneath a film of plastics material, using several possible techniques. A double wrapping may thus be effected in heat-retractable film, passing the load successively in a horizontal sheet of film and in a vertical sheet of film. A simple or double cover may also be made, by means of a heat-retractable or stretchable film, by providing an additional tightening means, after the load has been turned over.

Whatever the technique adopted for packing, it is indispensable to reinforce the mechanical strength of the film of plastics material used, at the position of the lateral spaces arranged for gripping purposes. In fact it is absolutely imperative to avoid any weakness of the packing of the load where these spaces are located, in order to avoid untimely tears during handling.

To make the above-mentioned reinforcement, it has already been envisaged to use either a single thick film of plastics material (of the order of 200 to 300 microns) or a mini-cover. However, not all these reinforcing elements have given satisfaction as they involve the use of a considerable quantity of plastics material, even in the zones where the extra thickness is not necessary. Furthermore, if a mini-cover is used, a regular distribution of the plastics material cannot be obtained due to the presentation of gussets after the covering operation.

SUMMARY OF THE INVENTION

It is an object of the present invention to overcome these drawbacks by using a reinforcing element of particular form, enabling the desired extra thickness to be obtained solely in the zones which must in fact be strengthened.

To this end, this packing for a pallet-less multi-layer load with a layer of reduced width defining lateral spaces for gripping purposes, each of these spaces, which are parallel to each other, having the form of a right-angled dihedron, comprising a plastic film element for protection and reinforcement applied on the reduced layer and the spaces for gripping, is characterised in that the protecting and reinforcing element is provided, in its parts adapted to be applied respectively on the faces of the dihedrons forming the spaces for gripping, with at least one additional band or strip folded inwardly and forming an extra thickness on the two faces of each of these dihedrons.

According to a further feature of the invention, the protecting and reinforcing element of plastic film is advantageously constituted by a section of sheath with gussets, the gussets being disposed either perpendicularly or parallel to the spaces for gripping. In the latter case, the packing of the load is reinforced, in the zone of each space for gripping, by four thicknesses of the plastic film constituting the protecting and reinforcing element.

The packing according to the invention thus offers the advantage of having a considerable extra thickness of material locally, solely where this extra thickness is necessary, and consequently the material wasted is reduced to a minimum. In addition, with the packing according to the invention, the plastic material is distributed very regularly over the whole surface of contact with the gripping members. Finally, the plastic material is highly resistant where the spaces for gripping are located, without lateral collapse during stacking.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
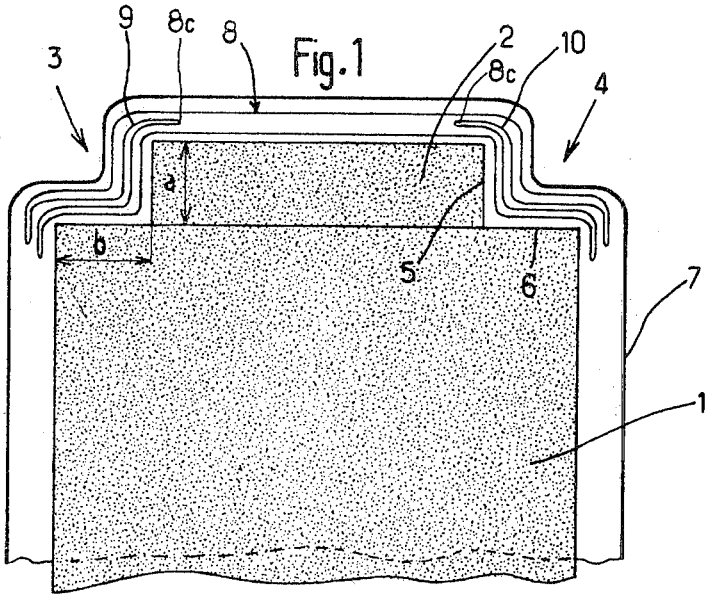
FIG. 1 is a partial schematic view in vertical section of a pallet-less multi-layer load whose upper layer is of reduced width, forming spaces for gripping purposes, comprising an outer cover and a protecting and reinforcing element constituted by a section of sheath with gussets disposed parallel to the spaces for gripping.
Figure 2:
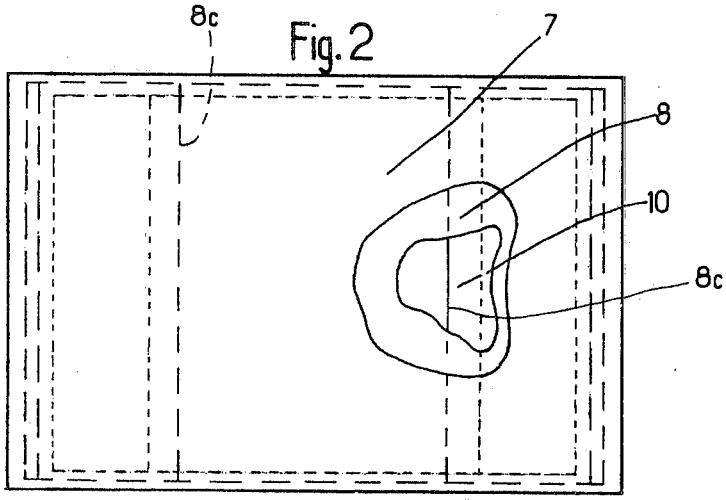
FIG. 2 is a plan view of the packed load of FIG. 1, with parts torn away.

Referring now to the drawings, FIGS. 1 and 2 show a pallet-less multi-layer load 1 which is constituted by a stack of articles, such as for example bags containing powdery products. This load comprises, in its upper part, a layer 2 of reduced width constituted by a fewer articles than in the other superposed layers constituting the load 1. Consequently, this reduced layer 2 defines, on either side, two lateral empty spaces 3 and 4 for gripping purposes. Each of these spaces 3 and 4 for gripping is in the form of a right-angled dihedron whose vertical face 5 is constituted by the lateral face of the reduced layer 2 whilst the horizontal face 6 is formed by the portion of horizontal face of the adjacent, normal layer, i.e. the one located beneath the reduced layer 2, which remains exposed.

The load 1 is packed by means of a cover 7 made of plastic material which covers all the load and which, after heat-retraction, takes the exact shape of the latter.

The lateral spaces 3 and 4 are intended to be used for positioning the fork of a fork-lift truck, after the load 1 has been turned over through 180°.

Figure 3:
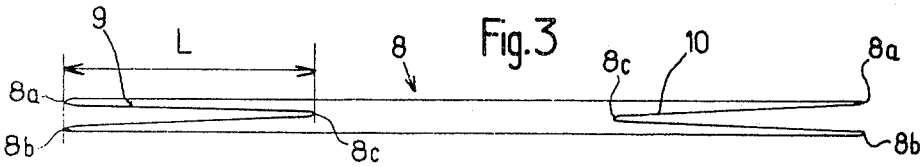
FIG. 3 is a view in transverse section of sheath with gussets which may be used as reinforcing and protecting element.

According to the invention, the packing of the load 1 comprises a protecting and reinforcing element 8 which covers the reduced layer 2 and the two dihedrons constituting the spaces 3 and 4. This protecting element is formed, in the embodiment of the invention shown in FIGS. 1 to 3, by means of a section of sheath with gussets which comprises two gussets 9 and 10 parallel to the spaces 3 and 4 and extending inwardly, in other words, towards each other, over a width L (FIG. 3). This width L is chosen so as to be slightly larger than the sum of the width a of the vertical face 5 of the dihedrons defining the spaces 3 and 4, and of the width b of the horizontal face 6 of each of these dihedrons. In this way, when the section of sheath 8 is applied on the upper bed 2, as shown in FIG. 1, it may be seen that the gussets 9 and 10 cover the two faces 5, 6 of the two dihedrons 3 and 4, their inner edges 8*c* extending above the reduced layer 2. The folded edges 8*a* and 8*b* from which the inner gussets 9 and 10 extend are preferably located slightly below the horizontal level of the last normal layer of the load 1, i.e. below the horizontal faces 6 of the dihedrons 3 and 4.

From the foregoing, it is therefore seen that the protecting and reinforcing element 8 defines, in the zone of each of the spaces 3 and 4, a superposition of four thicknesses of film of plastic material which extend along the vertical face 5 and the horizontal face 6 of each dihedron. An excellent reinforcement of these zones, which are particularly subject to tearing during handling of the load, is thus obtained.

Figure 4:
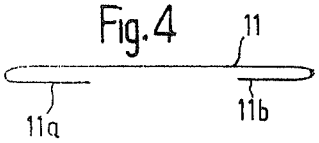
FIGS. 4, 5 and 6 are views in transverse section through various variant embodiment of the protecting and reinforcing element.

Naturally, although the use of a section of sheath 8 with gussets has proved to be particularly advantageous, other embodiments of the protecting and reinforcing element may be used. In FIG. 4, the protecting element 11 is constituted by a film of plastic material which is folded along two parallel edges so as to form two additional bands 11*a*, 11*b* directed towards each other, each of these folded bands 11*a*, 11*b* having a width at least equal to the sum of the widths a and b of the two faces 5, 6 of the dihedrons 3 and 4. In this case, each of the spaces 3 and 4 for gripping is reinforced by a double thickness of plastic film.

Figure 5:
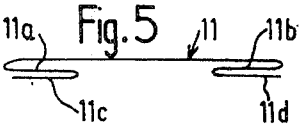

In the variant embodiment illustrated in FIG. 5, the film 11 of plastic material comprises, in addition to the additional inwardly folded bands 11*a* and 11*b*, two further bands 11*c* and 11*d* issuing from the preceding ones and in turn folded outwardly, the bands 11*c* and 11*d* extending substantially over the same width as the bands 11*a* and 11*b*. This arrangement enables three thicknesses of plastic film to be obtained in each space 3 and 4, to ensure protection and reinforcement.

Figure 6:
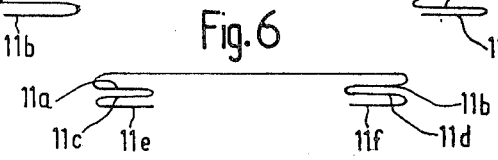
Figure 7:
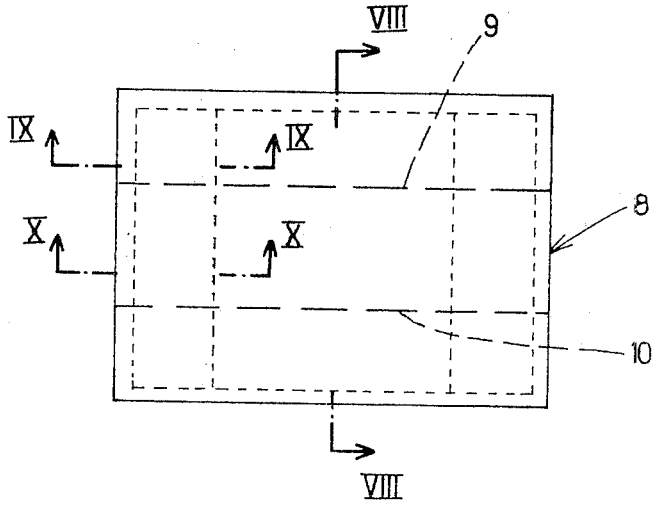
FIG. 7 is a plan view of a pallet-less layer load whose upper layer is of reduced width, forming spaces for gripping purposes, on which is applied a protecting and reinforcing element constituted by a section of sheath with gussets disposed perpendicularly to the spaces for gripping.
Figure 9:
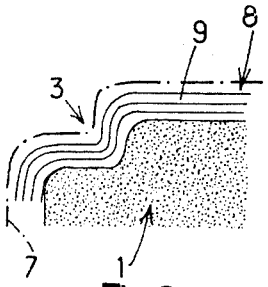
FIGS. 8, 9 and 10 are partial views in section made respectively along lines VIII—VIII, IX—IX and X—X of FIG. 7.
Figure 8:
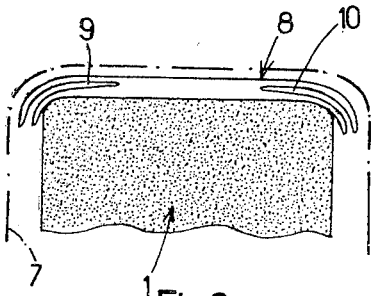
Figure 10:
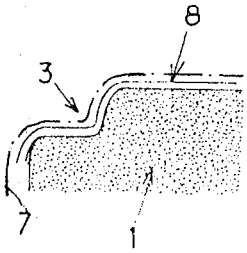

In the variant embodiment illustrated in FIG. 6, the film 11 of plastics material comprises, in addition to the four bands 11*a*, 11*b*, 11*c*, 11*d*, two further bands 11*e* and 11*f*, folded inwardly from bands 11*c* and 11*d* and substantially of the same width as the latter. Consequently, the film 11 shown in FIG. 6 enables four thicknesses of plastic film to be obtained, in each of the spaces 3 and 4, as in the case of the sheath 8.

The number of folded bands 11*a*–11*f* is of course not limiting and any number may be chosen as a function of the desired effect of reinforcement and of the thickness of the film of plastics material used.

Figure 11:
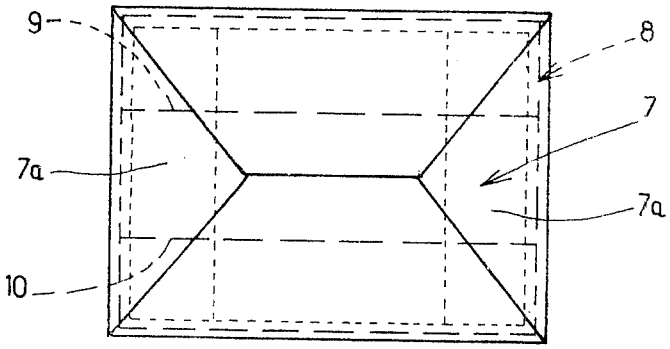
FIG. 11 is a plan view of the load of FIG. 7 finally covered with a heat-retractable cover.

FIGS. 7 to 11 illustrate a variant embodiment of the invention in which the gussets 9 and 10 of the protecting element 8 extend perpendicularly to the two dihedrons 3 and 4 constituting the spaces for gripping. This arrangement improves the distribution of the thicknesses of plastics material in the case of the protecting element 8 then being covered by a heat-retractable cover as shown in FIG. 11. In this case, the gussets 9, 10 ensure an extra thickness in the end zones of each of the spaces 3 and 4 for gripping whilst the gussets of the packing cover 7 ensure an extra thickness in the central zone 7*a* located between the two gussets 9, 10 of the protecting element 8.

The use of other reinforcing means may also be envisaged in the zones of the spaces 3, 4.

In particular, a plate of corrugated cardboard or of any other rigid material may be interposed between the last normal layer of the load and the reduced layer 2. This cardboard sheet which covers the horizontal faces 6 of each of the dihedrons 3, 4 may be provided with a layer of polyethylene in order subsequently to obtain a heat-welding or to be treated with an adhesive product allowing the film of the packing to be blocked when shaping is effected. A non-treated cardboard element might also be used, and an element composed of a film treated with a heat-weldable or adhesive product.

A heat-shaped reinforcing element from a flat plastics material adapted to the shape of the spaces 3, 4 may also be used.

What is claimed is:

1. In a packing for a pallet-less multi-layer load having a portion forming a layer of reduced width relative to the width of said load, said layer of reduced width having lateral spaces, gripping means in said lateral spaces for gripping said layer of reduced width, each of said gripping means including a vertical face and a horizontal face, the vertical faces being parallel to each other, said gripping means each having the form of a right-angled dihedron, comprising:

a protecting and reinforcing element of plastic film applied to the reduced layer and said gripping means;

said protecting and reinforcing element being applied to each said dihedrons on the faces thereof; and at least one additional band or strip folded inwardly and forming an extra thickness on each of the two said faces of each of said dihedrons.

2. The packing of claim 1, wherein the additional bands extend perpendicularly to the spaces for prehension.

3. The packing of claim 1, wherein the protecting film comprises, along its edges, three additional bands, namely a first band, folded inwardly, then a second band folded outwardly, then a third band, folded inwardly.

4. The packing of claim 1, wherein the additional bands extend parallel to the spaces for gripping.

5. The packing of claim 4, wherein the additional bands extend perpendicularly to the spaces for prehension.

6. The packing of claim 1, wherein the protecting and reinforcing element of the plastic film is constituted by a section of sheath with gussets.

7. The packing of claim 6, wherein the protecting and reinforcing element of plastic film is constituted by a film which is folded along two parallel edges so as to form two additional bands directed towards each other.

8. The packing of claim 6, wherein the protecting element comprises, along each of its edges, two additional bands, namely a first band, folded inwardly, then a second band folded outwardly from the preceding one.

9. The packing of claim 6, wherein the protecting film comprises, along its edges, three additional bands, namely a first band, folded inwardly, then a second band folded outwardly, then a third band, folded inwardly.

10. The packing of claim 9, wherein the additional bands extend parallel to the spaces for gripping.

11. The packing of claim 1, wherein the protecting and reinforcing element of plastic film is constituted by a film which is folded along two parallel edges so as to form two additional bands directed towards each other.

12. The packing of claim 11, wherein the protecting element comprises, along each of its edges, two additional bands, namely a first band, folded inwardly then a second band folded outwardly from the preceding one.

13. The packing of claim 11, wherein the protecting film comprises, along its edges, three additional bands, namely a first band, folded inwardly, then a second band folded outwardly, then a third band, folded inwardly.

14. The packing of claim 13, wherein the additional bands extend parallel to the spaces for gripping.

15. The packing of claim 1, wherein the protecting element comprises, along each of its edges, two additional bands, namely a first band, folded inwardly then a second band folded outwardly from the preceding one.

16. The packing of claim 15, wherein the additional bands extend parallel to the spaces for gripping.

17. The packing of claim 15, wherein the additional bands extend perpendicularly to the spaces for prehension.

18. The packing of claim 15, wherein the protecting film comprises, along its edges, three additional bands, namely a first band, folded inwardly, then a second band folded outwardly, then a third band, folded inwardly.

19. The packing of claim 18, wherein the additional bands extend parallel to the spaces for gripping.

20. The packing of claim 19, wherein the additional bands extend perpendicularly to the spaces for prehension.

* * * * *